US005307947A

United States Patent [19]

Moen et al.

[11] Patent Number: 5,307,947

[45] Date of Patent: May 3, 1994

[54] CONTAINER END MEMBER

[75] Inventors: Bruce A. Moen, Golden; Harold Cook, Jr., Evergreen, both of Colo.

[73] Assignee: Coors Brewing Company, Golden, Colo.

[21] Appl. No.: 688,910

[22] Filed: Apr. 19, 1991

Related U.S. Application Data

[63] Continuation-in-part of Ser. No. 443,510, Nov. 30, 1989, Pat. No. 5,011,037.

[51] Int. Cl.[5] ..... B65D 41/32

[52] U.S. Cl. ..... 220/266; 220/268; 220/269; 220/271

[58] Field of Search ..... 220/266, 268, 269, 270, 220/271

[56] References Cited

U.S. PATENT DOCUMENTS

| | | | |
|---|---|---|---|
| 3,779,417 | 12/1973 | Klein | 220/268 |
| 3,905,513 | 9/1975 | Klein | 220/268 |
| 3,929,251 | 12/1975 | Urmston | 220/268 |
| 4,148,410 | 4/1979 | Brown | 220/269 |
| 4,192.244 | 3/1980 | Kelley et al. | 413/17 |
| 4,585,140 | 4/1986 | Lambert et al. | 220/268 |
| 4,909,407 | 3/1990 | Lambert et al. | 220/268 |
| 5,011,037 | 4/1991 | Moen et al. | 220/271 |

*Primary Examiner*—Allan N. Shoap
*Assistant Examiner*—Nova Stucker
*Attorney, Agent, or Firm*—Klaas, Law, O'Meara & Malkin

[57] ABSTRACT

A container end member having a peripheral wall portion and an integral central wall portion is provided and which has at least one severable tab portion integral with the central wall portion and having a hinge portion having spaced apart ends and wherein a recessed portion is formed between the central end wall portion and the severable tab portion and has an axial thickness less than the axial thickness of the remaining portions of the central end wall portion and the severable tab portion and at least one severable score line groove having a main body portion and integral end portions defining the spaced apart ends of the hinge portion is formed in the recessed portion and at least a portion of the at least one score line groove extends in a transverse direction in the recessed portion. Also, apparatus is provided for controlling the amount of force applied to a container end member during the formation of a score line groove therein.

20 Claims, 3 Drawing Sheets

CONTAINER END MEMBER

This application is a continuation-in-part application of U.S. patent application Ser. No. 443,510 filed Nov. 30, 1989, now U.S. Pat. No. 5,011,037 for Container End Member.

FIELD OF THE INVENTION

This invention relates generally to an end member for a container and more specifically to such a container end member that is provided with a main opening for removing the contents within the container and another opening serving to relieve pressure or vacuum within the container or to form a vent opening.

BACKGROUND OF THE INVENTION

Many patents have been issued for end members for containers wherein the end member is provided with two openings, a main opening for removing the contents of the container and another opening serving to relieve pressure or vacuum within the container or to provide a vent. These patents fall into the following categories. Pull tab completely removed: U.S. Pat. Nos. 3,221,924; 3,273,745; 3,301,434; 3,302,818; 3,307,737; 3,313,446; 3,326,405; 3,434,622; 3,441,167; 4,135,637; 4,405,056; 4,705,186; Pressure relief and entire lid removed: U.S. Pat. Nos. 3,485,410; 3,593,876; 3,720,348; Resealable tab: U.S. Pat. Nos. 3,804,287; 3,858,747; 41,572,398; 4,576,306; Pull tab and panel removed: U.S. Pat. Nos. 3,627,168; 3,662,914; Push in tab: U.S. Pat. Nos. 3,741,432; 3,880,316; 3,886,881; 3,888,191; 3,970,212; 3,982,657; 4,023,703; 4,032,034; 4,078,695; 4,081,104; 4,105,134; 4,106,662; 4,119,050; 4,134,517; 4,136,797; 4,154,184; 4,155,480; 4,213,538; 4,355,935; 4,701,090. For many years, the most commonly used beverage containers have end members with a stay on tab which is used to apply a force to a severable tab portion to form an opening in the end member and after such opening has been formed, both the severable tab portion and the stay on tab remain attached to the end member. To applicants' knowledge, no container end member having a stay on tab has been provided with means of some nature for forming a vent opening therein. While some consumers have used a "church key" to form such a vent opening, it is more desirable to have an easily openable vent opening formed in the end member so that the vent opening can be formed whenever desired.

BRIEF DESCRIPTION OF THE INVENTION

This invention provides an end member for a beverage container which end member has a stay on tab for applying a force to a first severable tab portion to form a pour opening in the end member and a second severable tab portion having a raised surface so that a force may be applied thereto to form a vent opening in the end member. The invention also provides at least one severable score line groove in a portion of the severable tab portion having a reduced axial thickness to facilitate the tearing of the score line groove particularly in the formation of the vent opening.

In a preferred embodiment of the invention, an end member for a beverage container is provided and comprises a central end wall portion having a first severable tab portion formed therein and defined by score line groove means having spaced apart ends to form a hinge portion for the first severable tab portion. Force applying means are provided for applying an axially inwardly directed force on the first severable tab portion to sever it along the score line groove means to form a pour opening in the end member. Pivot means are permanently mounted on the central end wall portion for pivotally mounting the force applying means. The force applying means has an abutment end portion on one side of the pivot means for contacting the first severable tab portion and a handle portion on the other side of the pivot means so that, when an axially outwardly directed force is applied to the handle portion, the abutment end portion will apply an axially inwardly directed force on the first severable tab portion to form the pour opening. The pivot means keeps the force applying means secured to the central end wall portion and the hinge portion keeps the first severable tab portion secured to the central end wall portion. A second severable tab portion is formed in the central end wall portion at a location that is spaced from the first severable tab portion and has a hinge portion that is integral with the central end wall portion. The second severable tab portion has a raised surface projecting axially outwardly from the central end wall portion so that an axially inwardly directed force may be applied thereto to pivot the second severable tab portion about the hinge portion to form a vent opening.

In another preferred embodiment of the invention, a container end member for sealed association with a container body member to provide a sealed container is provided and comprises a one piece end member having a peripheral wall portion and an integral central end wall portion with at least one severable tab portion integral with said central end wall portion. A hinge portion is integral with the central end wall portion and has spaced apart ends. At least one severable score line groove is provided and has a main body portion and integral end portions defining the spaced apart ends of the hinge portion and defining the at least one severable tab portion so that the at least one severable tab portion may be pushed generally axially inwardly into the container body member to form an opening in the central end wall portion. A recessed portion projects axially inwardly from and is integral with the central end wall portion and the at least one severable tab portion and has an axial thickness less than the axial thickness of the remaining portions of the at least one severable tab portion and the central end wall portion. The recessed portion has an inner boundary and an outer boundary. The at least one severable score line groove is located in said recessed portion. At least a portion of the main body portion of the at least one severable score line groove extends in a transverse direction between the inner boundary and the outer boundary. The at least a portion of the main body portion of the severable score line groove has a first portion and at least a second portion. The first portion is located closer to the outer boundary than the at least a second portion so that spaced apart sections of the main body portion extend between the first portion and the at least a second portion. In one preferred embodiment of the invention, the recessed portion is continuous and in one modification has a generally annular shape and in another modification has a generally oval shape such as a shape having two arcuate end portions joined by two spaced apart linear portions. The portion of the at least one severable portion within the continuous recessed portion projects outwardly so that it is above the central end wall portion. While the invention is generally directed to the formation of the vent opening, it is understood that it may be used wherever it is desired to have a readily severable score line groove.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
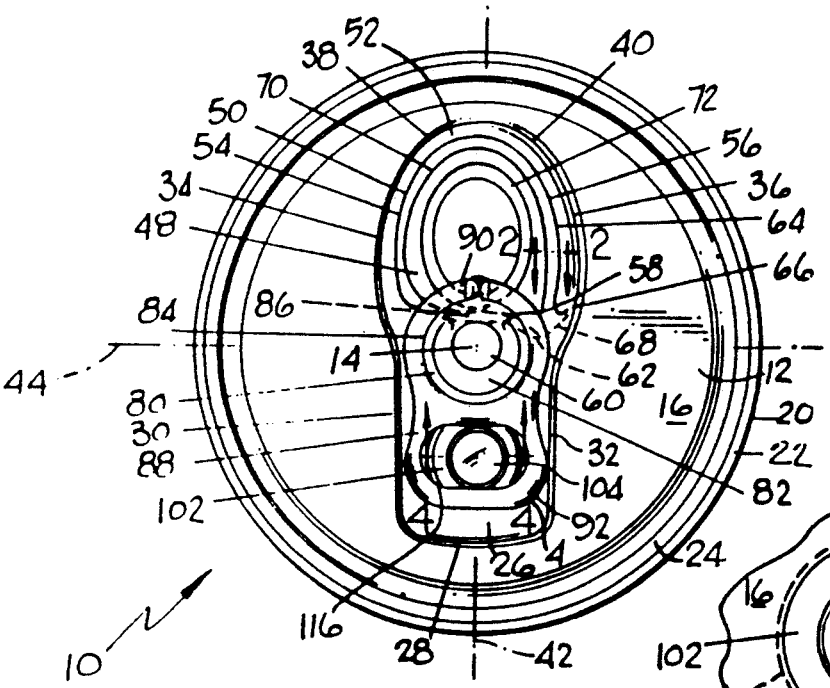
FIG. 1 is a top plan view of a container end member of this invention.
Figure 2:
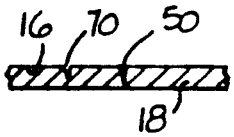
FIG. 2 is a cross-sectional view taken on the line 2—2 of FIG. 1.

In FIG. 1, there is illustrated a container end member 10, formed from a blank of sheet material such as, for example, an aluminum alloy of approximately 0.0108 inch in thickness having a central end wall portion 12 and a central axis 14, to provide an outer surface 16 and an inner surface 18, FIG. 2, when the container end member 10 is used with a container (not shown). The central end wall portion 12 is axially inwardly off-set from an annular exterior rim portion 20 having an axially outwardly facing end surface 22 and integrally connected to a generally radially inwardly directed flange portion 24 which is also integral with the central end wall portion 12.

A generally rectangularly shaped, axially inwardly depressed panel portion 26 is formed in the central end wall portion 12 and extends downwardly in an axially inward direction from the central end wall portion 12. The depressed panel portion 26 has an axially inwardly inclined outer end portion 28, two spaced apart generally parallel elongated axially inwardly inclined side edge portions 30 and 32 and two spaced apart curved, axially inwardly inclined edge portions 34 and 36 having central end portions 38 and 40. The container end member 10 has a first diametrical reference line 42 which bisects the depressed panel portion 26 and a second diametrical reference line 44 which is perpendicular to the first diametrical reference line 42.

A first severable tab portion 48 is located generally between the curved edge portions 34 and 36. The configuration of the severable tab portion 48 is defined by an outer score line groove 50 in the outer surface 16 of the depressed panel portion 26. The outer score line groove 50 has a curved portion 52 extending across the first diametrical reference line 42 and located adjacent to the end portions 38 and 40 of the depressed panel portion 26 and a pair of spaced curved side portions 54 and 56 on opposite sides of the first diametrical reference line 42. The curved side portion 54 has a terminal end portion 58 extending across the first diametrical reference line 42 and located a relatively small distance from a portion of the periphery of a central rivet 60, described below, and having a terminal end 62. The curved side portion 56 has a terminal end portion 64 having a terminal end 66 that is a quarter of a circle having a radius of about 0.030 inch. The curved end portion 52 and curved side portions 54 and 56 comprise the main body portion of the outer score line groove 50. An integral hinge portion 68 extends between the terminal end portion 62 and the terminal end 66. An inner score line groove 70, which is an insurance score line groove, has a configuration slightly smaller than the outer score line groove 50. Also, as illustrated in FIG. 2, the depth of the inner score line groove 70 is substantially less than the depth of the outer score line groove 50. The depth of the score line groove is expressed by the score residual, which is the material remaining in the groove, and for score line groove 50 the score residual is about 0.0032 inch and for score line groove 70, the score residual is about 0.0066 inch. A closed reinforcing rib 72 extends in an axially outward direction from the first severable tab portion 48 and has a configuration similar to a portion of, but slightly smaller than, the inner score line groove 70. The closed reinforcing rib 72 is bisected by the first diametrical reference line 42. The terminal end portion 62 connects the outer score line groove 50 and the inner score line groove 70 and has a radius of about 0.025 inch.

Force applying means are provided for applying an axially inwardly directed force on the first severable tab portion 48 so as to sever it along the outer score line groove 50 to form a pour opening in the central end wall portion 12. The force applying means comprise a central body portion 80 having an attachment portion 82 that is partially cut away from the central body portion 80 by a cut line 84 leaving a hinge portion 86. The attachment portion 82 has a central opening (not shown) so that it may be securely attached to the central end wall portion 12 by the rivet 60. A rigid lever portion 88 is integral with the hinge portion 86 and central body portion 80 and has an abutment end portion 90 and a handle end portion 92 so that a finger may be used to move the handle end portion 92 in an axially outward direction to pivot the rigid lever portion 88 around the hinge portion 86 so that the abutment end portion 90 applies an axially inwardly directed force on the first severable tab portion 48 to sever it along the outer score line groove 50. The hinge portion 68 retains the severed severable tab portion on the central end wall portion 12 and the hinge portion 86 retains the rigid lever portion 88 on the central end wall portion 12. Although the end member 10 has been described as having the depressed panel portion 26, it is understood that this is for illustrative purposes only and is not required for the purposes of this invention.

Figure 3:
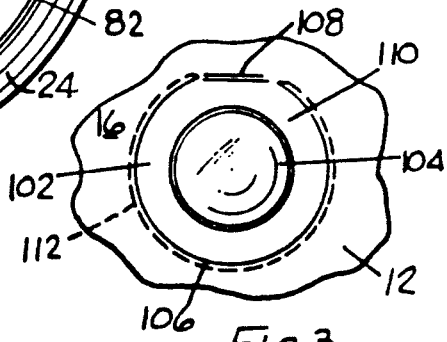
FIG. 3 is an enlarged view of the second severable tab portion.
Figure 4:
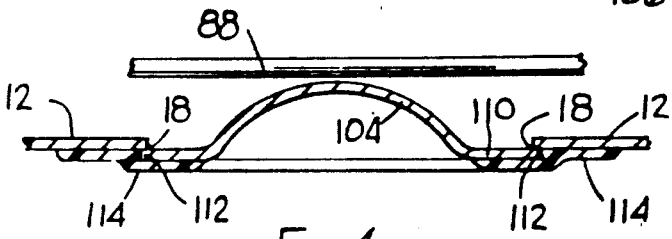
FIG. 4 is a cross-sectional view taken on the line 4—4 of FIG. 1.

A second severable tab portion, FIGS. 3 and 4, is provided and is used to form a vent opening in the central end wall portion 12. The second severable tab portion 102 is similar to the release vent tab in U.S. Pat. No. 3,741,432 which is incorporated herein by reference thereto. A raised surface 104 projects axially outwardly from the central end wall portion 12. A cut 106 partially surrounding the raised surface 104 is made in the central end wall portion 12 leaving a hinge portion 108. The cut away portion 110 is enlarged so as to form a lip 112 underlying the bottom surface 18 of the central end wall portion 12 bordering the cut 106. A sealant 114 is used to cover the overlapping portions. An opening 116 is formed in the handle portion to provide access to the raised surface 104. When it is desired to form the vent opening in the central end wall portion 12, an axially inwardly directed force is applied to the raised surface 104 to pivot the second severable tab portion 102 around the hinge portion 108 to form the vent opening. The hinge portion 108 retains the second severable tab portion 102 on the central end wall portion 12 after the vent opening has been formed.

The lever portion 88 surrounding the opening 116 has a thickness in the axial direction that is greater than the distance that the raised surface 104 projects from the depressed portion 26 to minimize the possibility of inadvertently moving the second severable tab portion 102 in an axially inward direction.

Figure 5:
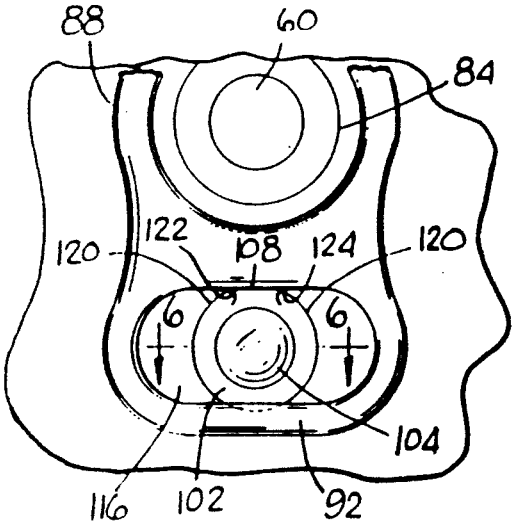
FIG. 5 is a top plan view of one embodiment of the second severable tab portion.
Figure 6:
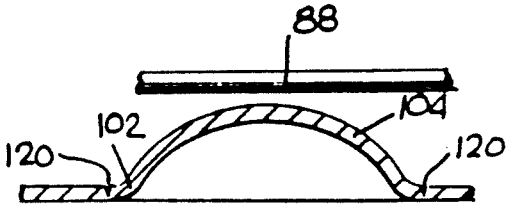
FIG. 6 is a cross-sectional view taken on the line 6—6 of FIG. 5.

In the embodiment of the invention illustrated in FIGS. 5 and 6, a score line groove means 120 partially surrounds the raised surface 104 and have terminal ends 122 and 124 that extend in directions away from each other to ensure that the hinge portion 108 remains after the vent opening is formed. The vent opening of FIGS. 5 and 6 is formed in the same manner as the vent opening in FIGS. 3 and 4 by applying an axially inwardly directed force on the raised surface 104.

Figure 7:
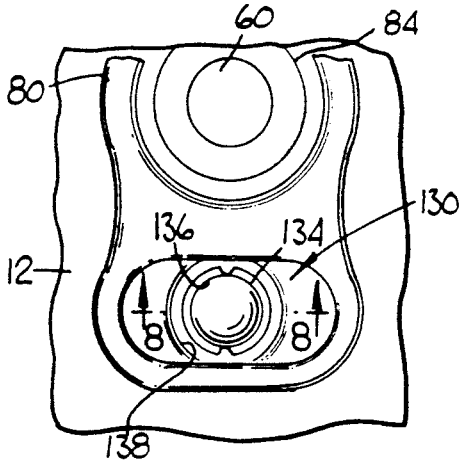
FIG. 7 is a top plan view of another embodiment of the invention.
Figure 8:
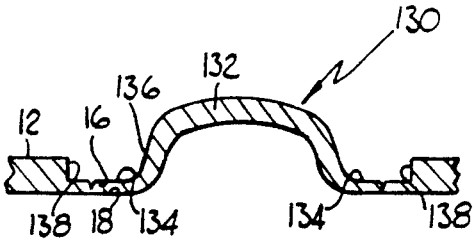
FIG. 8 is a cross-sectional view taken on the line 8—8 of FIG. 7.
Figure 9:
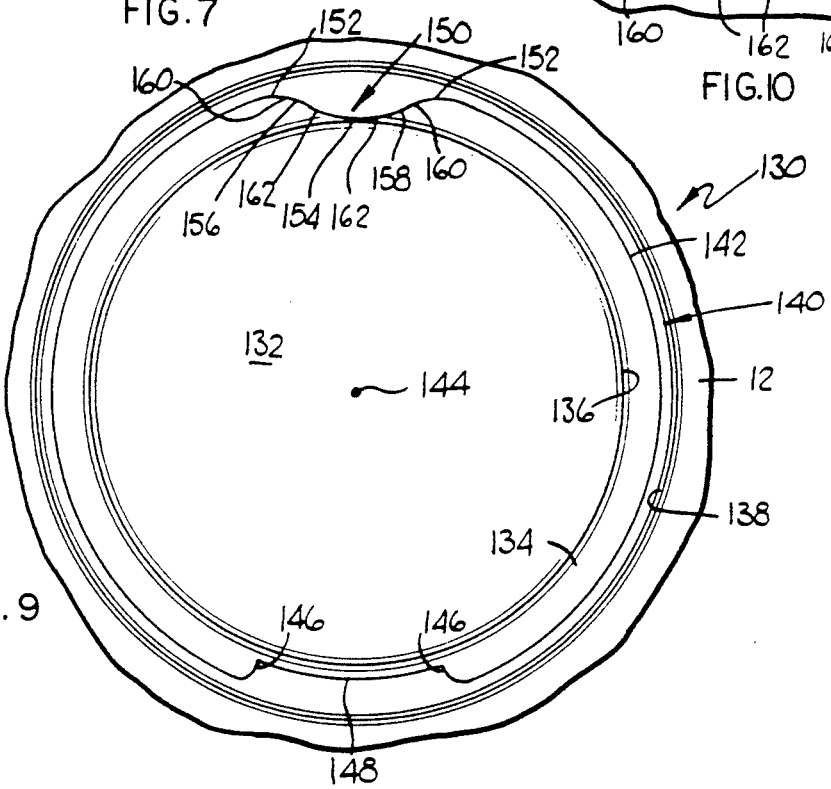
FIG. 9 is an enlarged top plan view of a portion of FIG. 7.

Another embodiment of the invention is illustrated in FIGS. 7–9 and comprises a second severable tab portion 130. Although the invention in FIGS. 7–15 is described in relation to a second severable tab portion 130 for use as described above, the severable tab portion and in particular the severable score line groove described below may be used wherever desired in a container end member having a severable tab portion. A raised portion 132 is formed, as described below, to project axially outwardly from the central end wall portion 12 so that it is above the plane of the central end wall portion 12. A recessed portion 134 is formed, as described below, between the central end wall portion 12 and the raised portion 132 and has an inner boundary 136 and an outer boundary 138. The recessed portion 134 projects downwardly from the central end wall portion 12 and has an axial thickness smaller than the axial thickness of the central end wall portion 12 and the raised portion 132 and preferably is between about 20 to 50 percent of the thickness of the central end wall portion 12. In preferred embodiments of the invention, the recessed portion 134 has an axial thickness of between about 0.0023 and 0.0035 inch and preferably of between about 0.0025 and 0.0031 inch. The central end wall portion 12 has an axial thickness of between about 0.0092 and 0.0108 inch and preferably of about 0.0096 inch. The sidewalls of the raised portion 132 have a thickness of between about 0.0092 and 0.0108 inch and preferably of about 0.0096 inch. The top portion of the raised portion 132 has a thickness of between about 0.0092 and 0.0108 inch and preferably of about 0.0096 inch. The foregoing statistics are given for one particular embodiment of the invention and will vary with other parameters of the service of the container, such as interior pressures, thickness of the central end wall portion, type of material and desired operational characteristics to obtain desired operational features. As illustrated in FIGS. 9 and 11, the recessed portion 134 is preferably continuous as in the form of a loop. In FIG. 9, the recessed portion 134 has an annular shape and in FIG. 11 has a generally oval shape having two arcuate end portions joined by two spaced apart linear portions.

A severable score line groove 140 is formed, as described below, in the recessed portion 134 of FIG. 9. The severable score line groove 140 has a main body portion 142 that is arcuately shaped having a radius of curvature having a center 144 coinciding with the center of the radius of curvature of the inner boundary 136 and the outer boundary 138. The main body portion 142 has terminal end portions 146 to provide a hinge portion 148 integral with the severable tab portion 130 and the recessed portion 134.

At least a portion 150 of the main body portion 142 extends in a transverse direction in the recessed portion 134, that is, generally from the outer boundary 138 toward the inner boundary 136. The at least a portion 150 has a first portion 152 and at least a second portion 154 with the first portion 152 being located closer to the outer boundary 138 than the at least the second portion 154. The at least a portion 150 has two sections 156 and 158 extending between the first portion 152 and the at least a second portion 154. Each of the sections 156 and 158 has a concave portion 160 and a convex portion 162 relative to the center 144 of the severable tab portion 130 to produce a change in inflection in each of the sections 156 and 158. It is understood that the score line groove means 120 of FIGS. 5 and 6 can be provided with a portion similar to the at least a portion 150 to facilitate the initiation of the severing of the severable tab portion 102.

Figure 10:
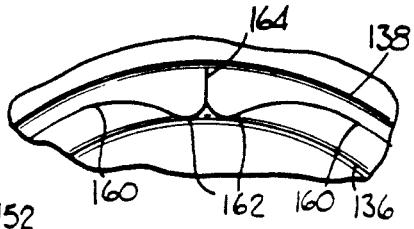
FIG. 10 is an enlarged top plan view of a portion of another embodiment of this invention.
Figure 11:
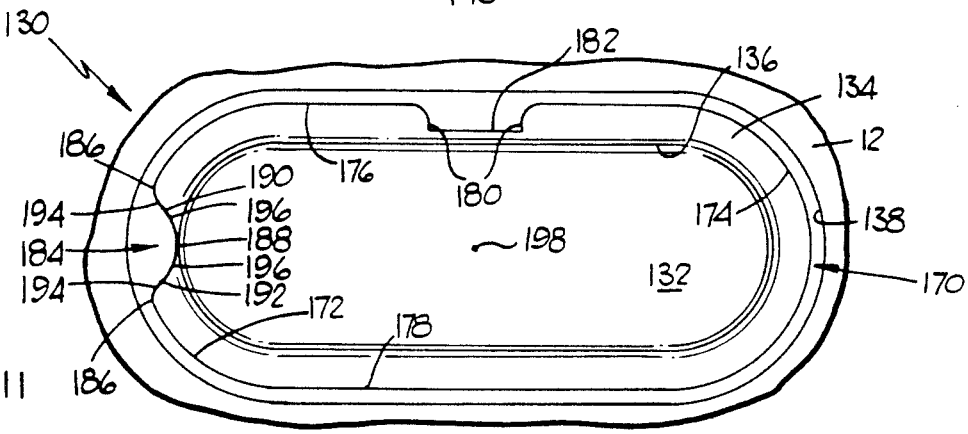
FIG. 11 is an enlarged top plan view of a further embodiment of the invention.

In FIG. 10, the convex portions 162 intersect and then extend generally as a substantially straight portion 164 toward the outer boundary 138.

Figure 15:
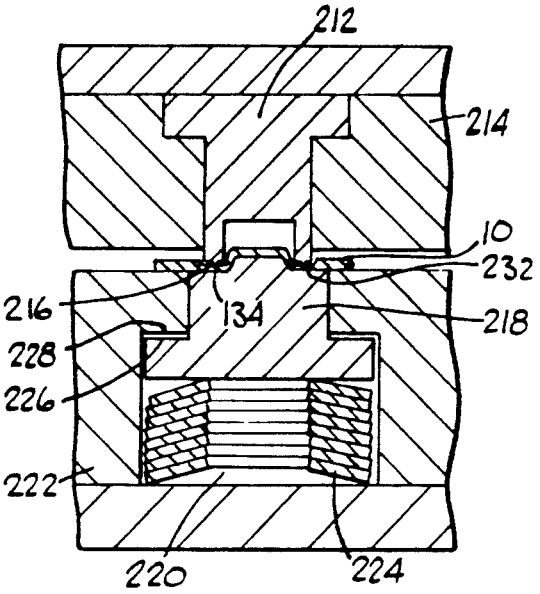
Figure 16:
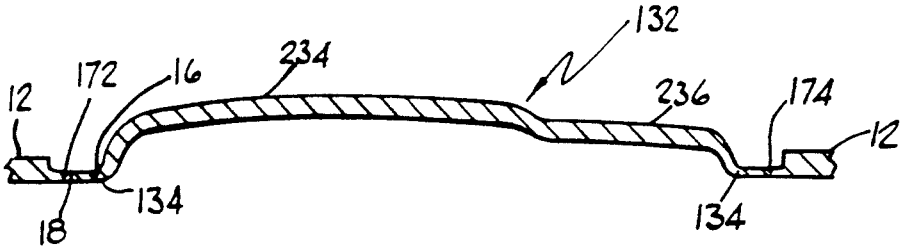
FIG. 16 is a view in cross-section of another preferred embodiment of the invention.

A severable score line groove 170 is formed, as described below, in the recessed portion 134 of FIG. 11. The severable score line groove 170 has a generally oval shaped main body portion comprising a pair of spaced apart arcuate sections 172 and 174 joined by two spaced apart linear sections 176 and 178. The linear section 176 has terminal end portions 180 to provide a hinge portion 182 integral with the severable tab portion 130 and the recessed portion 134. It is understood that the terminal end portions 180 could be formed in the linear portion 178 or the arcuate portion 174. Also, instead of being directed to the outer boundary 138, they can be directed toward the inner boundary 136. The raised portion 132 of FIG. 10 has a generally oval shape. While the score line grooves 140 and 170 are illustrated in FIGS. 8 and 15 as being formed in the outer surface 16, they can be formed in the inner surface 18.

At least a portion 184 of the arcuate portion 172 extends in a transverse direction in the recessed portion 134. The at least a portion 184 has a first portion 186 and at least a second portion 188 with the first portion 186 being located closer to the outer boundary 138 than the at least a second portion 188. The at least a portion 184 has two sections 190 and 192 extending between the first portions 186 and the at least a second portion 188.

Each of the sections 190 and 192 has a concave portion 194 and a convex portion 196 relative to the center 198 to produce a change in inflection in each of the sections 190 and 192. It is understood that the at least a portion 184 can be formed in the linear portions 176 and 178 or the arcuate portion 174.

Figure 12:
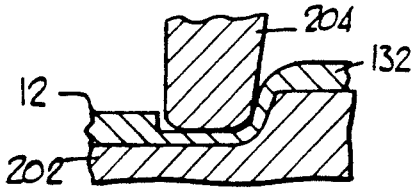
FIGS. 12 and 13 illustrate steps in the formation of a coined outer surface for a severable tab portion.
Figure 13:
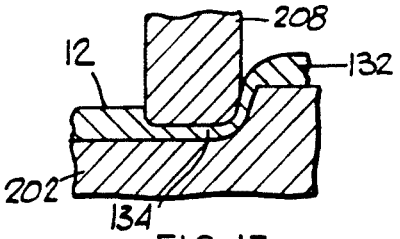

The formation of the recessed portion 134 is illustrated in FIGS. 11 and 12. An anvil die 202 is mounted at a fixed location. The central end wall portion 12 is positioned over the anvil die 202. A first forming tool 204 is mounted for reciprocation so that it moves into contact with the central end wall portion 12 to form the raised portion 132 and the reduced thickness recessed portion 134. In order to form a more distinct recessed portion 134, a second forming tool 208 is used in another forming operation.

Figure 14:
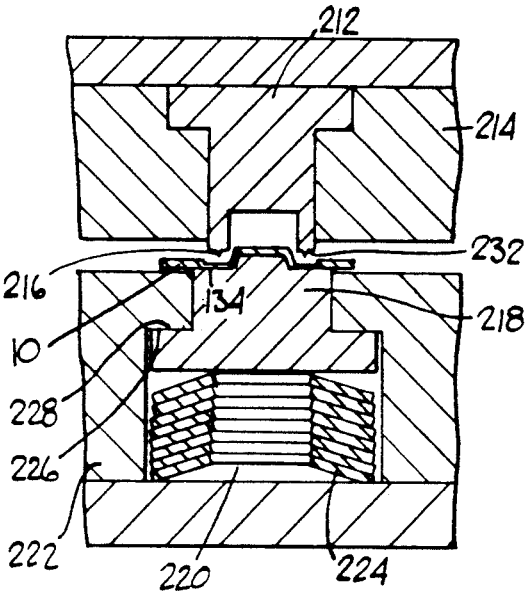
FIGS. 14 and 15 illustrate the steps in the formation of a severable score line groove in a recessed outer surface.

The formation of the severable score line groove 140 or 170 is illustrated in FIGS. 14 and 15. A severable groove forming tool 212 is mounted in a split housing 214 and has a groove forming die 216 extending outwardly therefrom. The split housing 214 is mounted by conventional means (not shown) for reciprocal movement. An anvil 218 is mounted in a cavity 220 in a split housing 222 and a plurality of belleville springs 224 urge a shoulder 226 of the anvil 218 against an abutment surface 228 of the cavity 220. A container end member 10 is positioned on the anvil 218 so that the recessed portion 134 thereof will be contacted by the groove forming die 216. In operation, the forming tool 212 is moved toward the recessed portion 134. The groove forming die 216 will contact and move into the recessed portion 134 to form the severable score line groove 140 or 170. The belleville washers 224 will hold the shoulder 226 against the abutment surface 228 until a predetermined amount of force, such as about 1,000 pounds, is being applied by the surface portion 232 of the groove forming tool 216 against the recessed portion 134. Any additional force applied by further movement of the groove forming tool 216 will cause the belleville washers 224 to permit movement of the shoulder 226 away from the abutment surface 228 so as to limit the amount of force applied by the surface portion 232 against the recessed portion 134 to prevent further coining or reduction in axial thickness of the recessed portion 134 and prevent further penetration of the groove forming die 216 into the metal. This sets a limit on the minimum score residual possible thus preventing score residuals that are not within specification. The movement of the anvil 218 will be very small.

In operation, a force is applied to the raised portion 132 to generate force lines concentric with or parallel to the inner or outer boundaries 136 and 138. These force lines will exert pressures on the sections 156 and 158 or 190 and 192 to initiate severing of the severable score line groove 140 or 170. In the preferred embodiment of the invention, the second portions 154 or 188 are tangent to the lower portions of the inner boundaries 136. Imaginary linear lines extending through the sections 156 and 158 or 190 and 192 would form an included angle of between about 120 and 150 degrees and preferably of about 135 degrees. If the convex portions 162 or 196 are made linear, the apex thereof would be in the lower portion of the inner boundary 136. The residual of the severable score line groove 140 or 170 should be between about 0.0010 and 0.0025 inch depending on the axial extent of the recessed portion 134.

In FIG. 15, there is illustrated in cross-section another preferred embodiment of the invention which has a generally oval shape similar to that illustrated in FIG. 10 and wherein the corresponding parts are identified with the same reference numerals. The raised portion 132 comprises two separate integral sections 234 and 236 with the section 234 being spaced a greater distance from the central end wall portion 12 than the section 236. This ensures that, when a force is applied to the section 234, the initial severing of the score line groove will be at the desired location.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A container end member for sealed association with a container body member to provide a sealed container comprising:

a one piece end member having a peripheral wall portion and an integral central end wall portion;

at least one severable tab portion integral with said central end wall portion;

a hinge portion integral with said central end wall portion and having spaced apart ends;

at least one severable score line groove having a main body portion and integral end portions defining said spaced apart ends of said hinge portion and defining said at least one severable tab portion so that said at least one severable tab portion may be pushed generally axially inwardly into said container body member to form an opening in said central end wall portion;

a recessed portion having an axial thickness less than the axial thickness of the remaining portions of said at least one severable tab portion and said central end wall portion and located between and integral with said central end wall portion and said severable tab portion;

said at least one severable score line groove being located in said recessed portion; and at least a portion of said main body portion of said at least one severable score line groove extending, generally in a transverse direction in said recessed portion.

2. The invention as in claim 1 and further comprising:

said recessed portion having an inner boundary and an outer boundary.

3. The invention as in claim 2 and further comprising:

said at least a portion of said main body portion having a first portion and at least a second portion; and said first portion being located closer to said outer boundary than said at least a second portion.

4. The invention as in claim 3 and further comprising:

spaced apart sections of said at least a portion of said main body portion extending between said first portion and said at least a second portion.

5. The invention as in claim 4 wherein:

said recessed portion is generally annular in shape.

6. The invention as in claim 4 wherein:

said recessed portion is generally oval in shape.

7. The invention as in claim 4 wherein:

said recessed portion has two arcuate end portions joined by two spaced apart linear portions.

8. The invention as in claim 2 wherein:

the portion of said at least one severable tab portion located within said outer boundary projecting axially outwardly above said central end wall portion.

9. The invention as in claim 1 wherein:

said recessed portion is continuous.

10. The invention as in claim 9 wherein:

said continuous recessed portion having an inner boundary and an outer boundary.

11. The invention as in claim 10 and further comprising:

said at least a portion of said main body portion having a first portion and at least a second portion; and said first portion being located closer to said outer boundary than said at least a second portion.

12. The invention as in claim 11 wherein:

spaced apart sections of said at least a portion of said main body portion extending between said first portion and said at least a second portion.

13. The invention as in claim 12 wherein:

said continuous recessed portion is generally annular in shape.

14. The invention as in claim 12 wherein:

said continuous recessed portion is generally oval in shape.

15. The invention as in claim 12 wherein:

said continuous recessed portion has two arcuate end portions joined by two spaced apart linear portions.

16. A container end member for sealed association with a container body member to provide a sealed container comprising:

a one piece end member having a peripheral wall portion and an integral central end wall portion;

at least one severable tab portion integral with said central end wall portion;

a hinge portion integral with said central end wall portion and having spaced apart ends;

at least one severable score line groove having a main body portion and integral end portions defining said spaced apart ends of said hinge portion and defining said at least one severable tab portion so that said at least one severable tab portion may be pushed generally axially inwardly into said container body member to form an opening in said central end wall portion;

at least one axially inwardly projecting portion having a first portion comprising a part of said at least one severable tab portion and a second portion comprising a part of said central end wall portion;

said at least one severable score line groove being located in said at least one axially inwardly projecting portion;

said at least one severable tab portion having a center point;

said at least one severable score line groove having at least one arcuate portion; and said at least one arcuate portion having at least one concave portion and at least one convex portion in relation to said center point.

17. The invention as in claim 16 and further comprising:

said at least one axially inwardly projecting portion having an inner boundary and an outer boundary; and said at least one concave portion being located closer to said outer boundary than said convex portion.

18. The invention as in claim 17 wherein:

said at least one concave portion comprises a pair of spaced apart concave portions; and said convex portion located between and integral with said pair of spaced apart concave portions.

19. A container end member or the like for sealed association with a container member to provide a sealed container and which is provided with a system for forming openings therein comprising:

a one piece end member having a central axis;

an annular exterior rim portion on said end member for sealed association with the container member;

a central end wall portion integrally connected to said annular exterior rim portion and extending generally transversely to said central axis and having an outer surface and an inner surface;

a first severable tab portion in and integrally connected to said central end wall portion;

a first hinge portion integral with said central end wall portion and having spaced apart ends;

severable score line groove means having ends adjacent to said spaced apart ends of said first hinge portion and defining said first severable tab portion so that said first severable tab portion may be severed from said central wall portion in response to applied axially inwardly directed forces and form a pour opening in said central end wall portion;

force applying means for applying said axially inwardly directed forces on said severable tab portion;

pivot means permanently mounted on said central end wall portion for pivotally mounting said force applying means on said central end wall portion;

said force applying means having an abutment end portion for contacting said first severable tab portion and a handle end portion so that, when an axially outwardly directed force is applied to said handle portion, said force applying means will pivot about said pivot means so that said abutment end portion will apply said axially inwardly directed forces to said first severable tab portion to sever said first severable tab portion along said first score line groove means and form said pour opening in said central end wall portion;

a second severable tab portion in and integrally connected to said central end wall portion;

said second severable tab portion being located in said central end wall portion at a location spaced from said first severable tab portion;

a second hinge portion integral with said central end wall portion and said second severable tab portion;

said second severable tab portion having a raised surface projecting axially outwardly from said central end wall portion so that an axially inwardly directed force may be applied thereto to sever said second severable tab portion and form a vent opening in said central end wall portion;

retaining means for retaining said first severable tab portion, said force applying means and said second severable tab portion on said end member after said pour and vent openings have been formed;

said second hinge portion having spaced apart ends;

at least one severable score line groove having a main body portion and integral end portions defining said spaced apart ends of said second hinge portion and defining said second severable tab portion so that said second severable tab portion may be pushed generally axially inwardly into said container body member to form an opening in said central end wall portion;

a recessed portion having an axial thickness less than the axial thickness of the remaining portions of said second severable tab portion and said central end wall portion and located between and integral with said central end wall portion and said second severable tab portion;

said at least one severable score line groove being located in said recessed portion; and at least a portion of said main body portion of said at least one severable score line groove extending generally in a transverse direction in said recessed portion.

20. The invention as in claim 19 and further comprising:

said second severable tab portion having a center point; and said at least a portion of said main body portion of said at least one severable score line groove having at least one concave portion and at least one convex portion in relation to said center point.

* * * * *